US012233351B2

(12) United States Patent
Shieldkret et al.

(10) Patent No.: US 12,233,351 B2
(45) Date of Patent: Feb. 25, 2025

(54) FIGURINE PERCH

(71) Applicant: JSJ Design Company LLC, Longview, TX (US)

(72) Inventors: Jennifer Shieldkret, Maple Valley, WA (US); Judith McWilliams, Longview, TX (US); Suzanne Tillmond, Normandy, MO (US)

(73) Assignee: JSJ Design Company LLC, Longview, TX (US)

( * ) Notice: Subject to any disclaimer, the term of this patent is extended or adjusted under 35 U.S.C. 154(b) by 0 days.

(21) Appl. No.: 18/663,153

(22) Filed: May 14, 2024

(65) Prior Publication Data

US 2024/0382860 A1 Nov. 21, 2024

Related U.S. Application Data

(60) Provisional application No. 63/467,189, filed on May 17, 2023.

(51) Int. Cl.
*A63H 3/50* (2006.01)
*A63H 3/00* (2006.01)

(52) U.S. Cl.
CPC ..... *A63H 3/50* (2013.01); *A63H 3/008* (2013.01)

(58) Field of Classification Search
CPC . A63H 3/50; A47F 7/00; A47F 7/0021; A47F 7/0028
See application file for complete search history.

(56) References Cited

U.S. PATENT DOCUMENTS 2,467,139 A * 4/1949 Links ..... A63H 13/20 446/236
3,194,403 A * 7/1965 Van Horn, Jr. ..... A47F 5/04 D7/619.1
3,418,746 A * 12/1968 Kharasch ..... A63H 3/50 446/83
3,675,362 A * 7/1972 De Gelder ..... A63H 7/04 446/366
3,699,712 A * 10/1972 Handler ..... A63H 13/18 248/346.04
5,107,775 A * 4/1992 Langlais ..... A47B 9/14 248/188.5
5,116,044 A * 5/1992 Wilkinson ..... A63B 23/0458 482/52
5,560,500 A * 10/1996 Wilcox ..... A47F 7/00 211/13.1

(Continued)

*Primary Examiner* — Kurt Fernstrom
(74) *Attorney, Agent, or Firm* — H. Brock Kolls

(57) ABSTRACT

The present invention relates to a figurine perch that when placed on top of a non-flat oddly shaped display structure provides a secure and level surface so that at least one figurine can be placed for display. The figurine perch includes a platform with a plurality of platform holes and a raised contoured retaining ridge. Standoffs are affixed to the bottom of the platform and stabilizing mounts that include a leg segment and a rod segment are fitted into the standoffs in an adjustable manner. In exemplary embodiments, at least one of the leg segments can be a different length than the other leg segments, a gripping plug can be fitted into a recess in the surface-contacting end of the leg segment to abate slipping of the figurine perch, and light sources can be interconnected with and passes through at least some of the platform holes.

20 Claims, 14 Drawing Sheets

(56) References Cited

U.S. PATENT DOCUMENTS

| | | | | |
|---|---|---|---|---|
| 6,471,166 | B1 * | 10/2002 | Toettcher | F16M 11/24 248/125.1 |
| 9,149,730 | B1 * | 10/2015 | Hauser | A63H 3/50 |
| 2012/0178337 | A1 * | 7/2012 | Wittenberg | A63H 3/50 446/268 |
| 2014/0011421 | A1 * | 1/2014 | Martinez | A63H 3/50 446/73 |
| 2019/0321738 | A1 * | 10/2019 | Chambers | A63H 3/00 |

* cited by examiner 128
134
136
104
130
210
214
100
108
102
132
106
124
110

*Fig. 8*
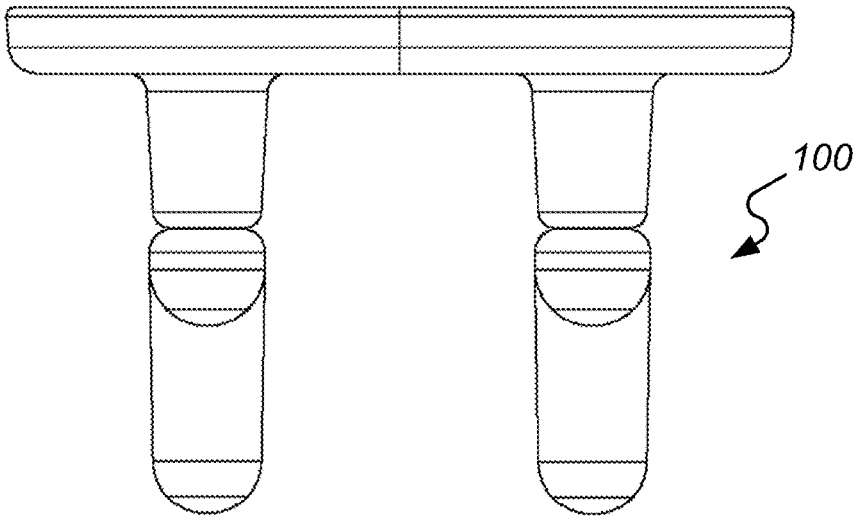
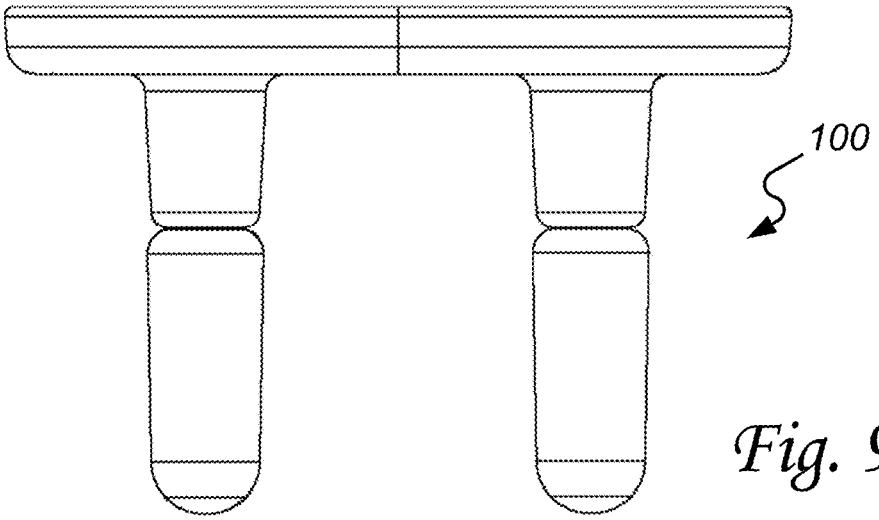
*Fig. 9*

Fig. 12
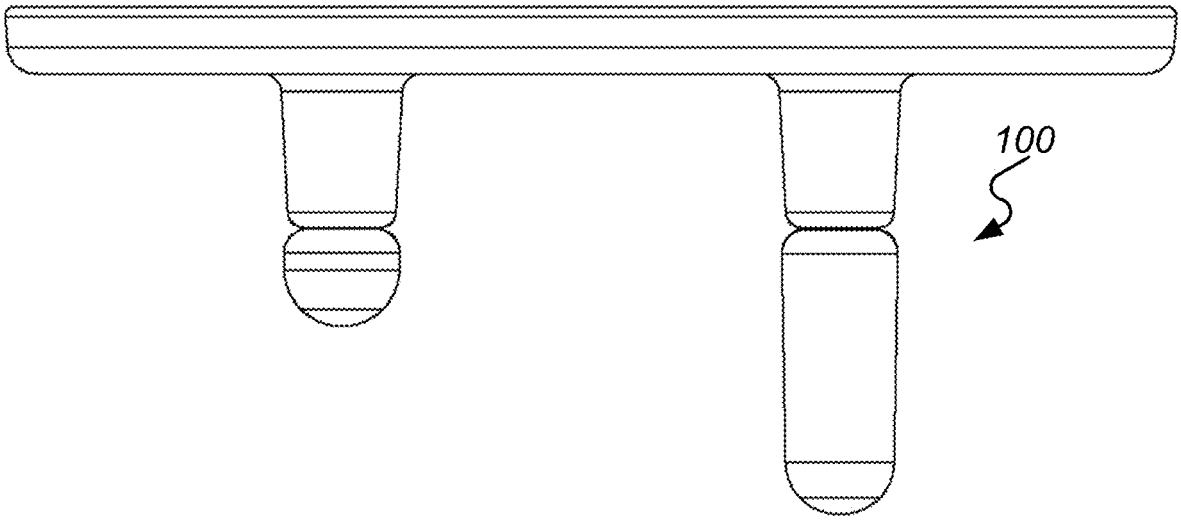
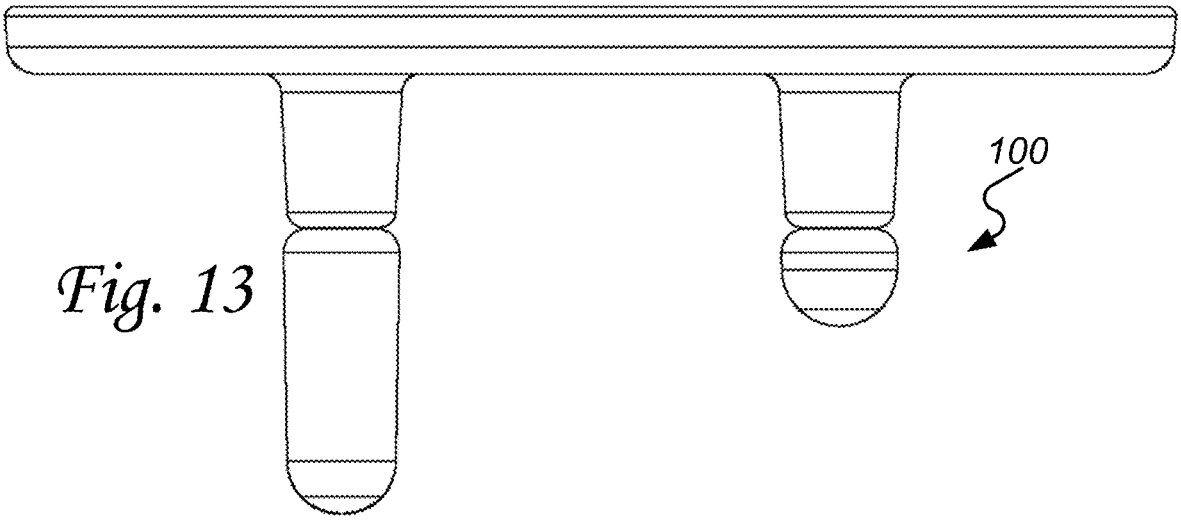
Fig. 13

FIGURINE PERCH

CROSS-REFERENCE TO RELATED APPLICATIONS

This application contains subject matter which is related to the subject matter of the following co-pending application. The below-listed application is hereby incorporated herein by reference in its entirety:

This is a U.S. non-provisional application that claims the benefit of a U.S. provisional application, Ser. No. 63/467,189, inventor Jennifer Shieldkret et al., entitled "FIGURINE PERCH", filed May 17, 2023.

TECHNICAL FIELD OF THE INVENTION

This invention relates to a figurine perch and particularly to a figurine perch that can provide a secure and level place so that at least one figurine can be placed, for display in a manner that prevents the figurine from falling off the non-flat oddly shaped display structure.

BACKGROUND OF THE INVENTION

Before our invention trying to display a figurine on top of an oddly shaped display surface was not practical and often resulted in the figurine falling off the display surface.

The present invention addresses these and other shortcomings by providing a figurine perch that when placed on top of a non-flat oddly shaped display structure provides a secure and level surface so that at least one figurine can be placed for display. For these reasons and shortcomings as well as other reasons and shortcomings there is a long-felt need that gives rise to the present invention.

SUMMARY OF THE INVENTION

The shortcomings of the prior art are overcome and additional advantages are provided through the provision of a figurine perch that when placed on top of a non-flat oddly shaped display structure provides a secure and level surface so that at least one figurine can be placed for display. The figurine perch comprises a platform having a top surface and a bottom surface. The surface of the platform has more than one platform hole positioned around and proximate to the perimeter of the platform. A raised contoured retaining ridge is positioned around the perimeter of the top surface and configured to abate objects from sliding off the top surface of the platform during use. More than one standoff. Each of the standoff is affixed to the bottom surface. And, more than one stabilizing mount. The stabilizing mount comprises a leg segment and a rod segment which is attached to one end of the leg segment and the other end of the leg segment is a surface-contacting end. The rod is fitted into the standoff in an adjustable manner.

In operation, the length of each of the stabilizing mount is adjusted so that the platform is secure and level when placed on top of the non-flat oddly shaped display structure so that at least one figurine can be placed, for display, on the platform in a manner that prevents the figurine from falling off the non-flat oddly shaped display structure.

Additional, shortcomings of the prior art are overcome and additional advantages are provided through the provision of a figurine perch that when placed on top of a non-flat oddly shaped display structure provides a secure and level surface so that at least one figurine can be placed for display. The figurine perch comprises. A platform has a top surface and a bottom surface. The surface of the platform has more than one platform hole positioned around and proximate to the perimeter of the platform. A raised contoured retaining ridge is positioned around the perimeter of the top surface and configured to abate objects from sliding off the top surface of the platform during use. More than one standoff has a threaded interior surface. Each of the standoffs is affixed to the bottom surface. And, more than one stabilizing mount. The stabilizing mount comprises a leg segment and a rod segment that is threaded, at least one of the leg segments is a different length than the other of the leg segment. The rod segment attaches to one end of the leg segment the other end of the leg segment is a surface-contacting end. The rod segment screws into the threaded interior surface of the standoff in an adjustable manner.

In operation, the length of each of the stabilizing mount is adjusted so that the platform is secure and level when placed on top of the non-flat oddly shaped display structure so that at least one figurine can be placed, for display, on the platform in a manner that prevents the figurine from falling off the non-flat oddly shaped display structure.

Additional, shortcomings of the prior art are overcome and additional advantages are provided through the provision of a figurine perch that when placed on top of a non-flat oddly shaped display structure provides a secure and level surface so that at least one figurine can be placed for display. The figurine perch comprises a platform having a top surface and a bottom surface. The surface of the platform has more than one platform hole positioned at a predetermined spacing interval. A raised contoured retaining ridge is positioned and integrally formed around the perimeter of the top surface. The raised contoured retaining ridge is configured to abate objects from sliding off the top surface of the platform during use. More than one standoff has a threaded interior surface, each standoff is integrally formed on the bottom surface. More than one of a stabilizing mount. The stabilizing mount comprises a leg segment and a rod segment that is threaded. At least one of the leg segments is a different length than the other of the leg segments. The rod segment attaches to one end of the leg segment the other end of the leg segment is a surface-contacting end. The rod segment screws into the threaded interior surface of the standoff in an adjustable manner. And, a gripping plug, the surface-contacting end of the leg segment has a recess. The gripping plug is fitted into the recess, wherein the leg segment is abated from slipping, by way of the gripping plug, when in contact with the non-flat oddly shaped display structure.

In operation, the length of each of the stabilizing mount is adjusted so that the platform is secure and level when placed on top of the non-flat oddly shaped display structure so that at least one figurine can be placed, for display, on the platform in a manner that prevents the figurine from falling off the non-flat oddly shaped display structure.

Additional features and advantages are realized through the techniques of the present invention. Other embodiments and aspects of the invention are described in detail herein and are considered a part of the claimed invention. For a better understanding of the invention with advantages and features, refer to the description and the drawings.

BRIEF DESCRIPTION OF THE FIGURES

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

FIGS. 2-13 illustrate exemplary embodiments of a figurine perch;

FIG. 18 illustrates one example of a method of using a figurine perch.

The detailed description explains the preferred embodiments of the invention, together with advantages and features, by way of example with reference to the drawings.

DETAILED DESCRIPTION OF THE INVENTION

Figure 1:
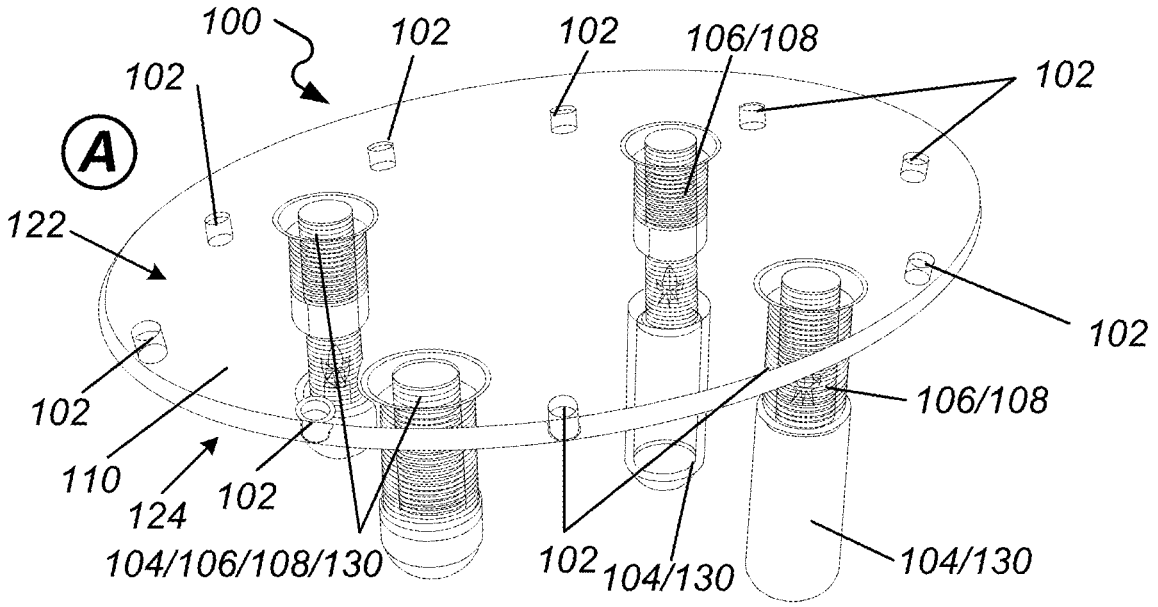
FIG. 1 illustrates one example of a figurine perch placed on top of a non-flat oddly shaped display structure, providing a secure and level surface so that at least one figurine can be placed for display.
Figure 1:
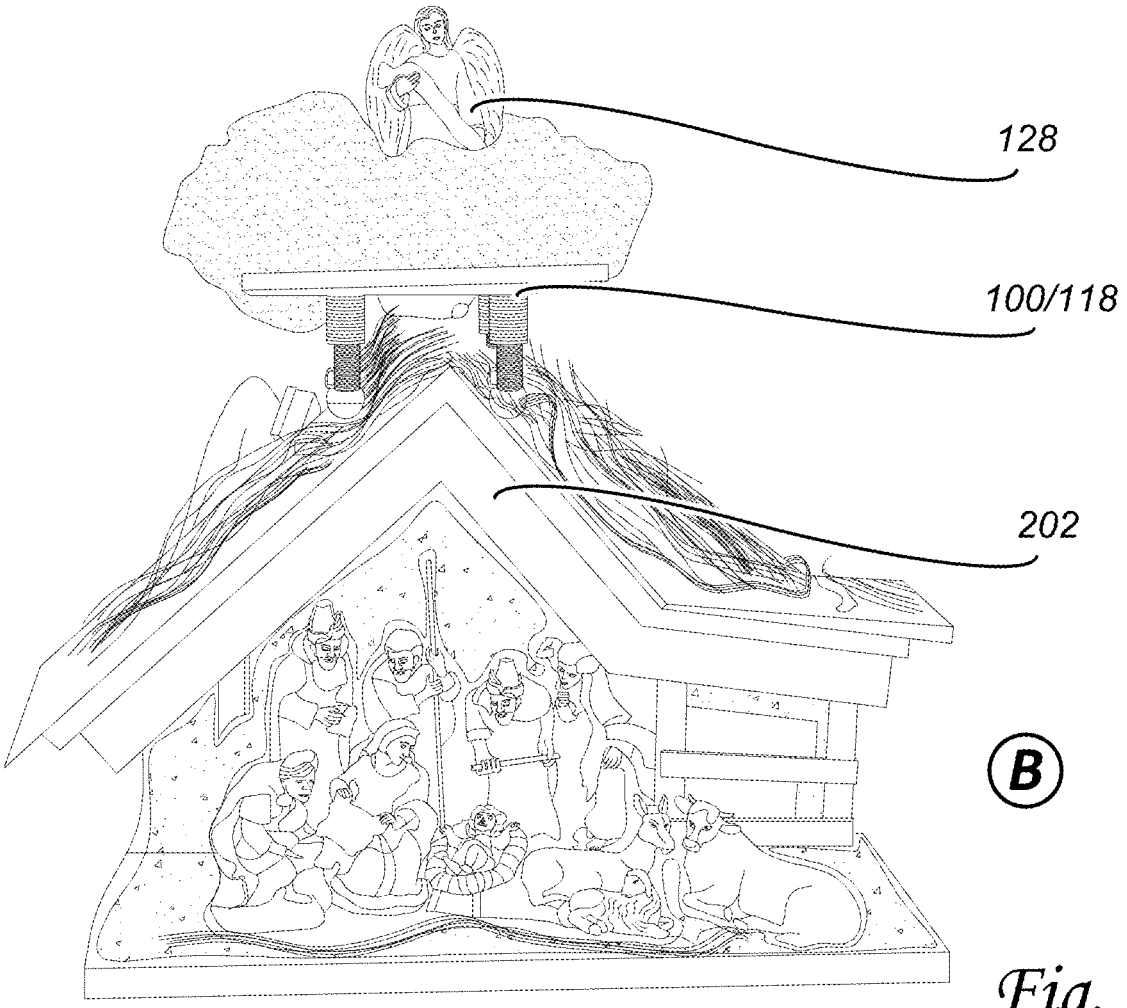

Turning now to the drawings in greater detail, it will be seen that in FIG. 1 there is one example of figurine perch 100 placed on top of a non-flat oddly shaped display structure 202, providing a secure and level surface so that at least one figurine 128 can be placed for display. In an exemplary embodiment, in reference 'A' the figurine perch 100 can comprise a platform 110 having a top surface 122 and a bottom surface 124. The surface of platform 110 can have more than one platform hole 102 positioned around and proximate to the perimeter of platform 110.

In an exemplary embodiment, platform 110 can be fabricated from plastic, metal, wood, glass, a combination thereof, or other suitable materials. In a preferred embodiment, platform 110 can be fabricated from clear plastic.

In the present invention, the term "perch" as in figurine perch is intended to mean a high or elevated position, a resting place, or the like.

In an exemplary embodiment, platform holes 102 can be used for wiring for lights, hangers 114, and other items. In this regard, such items can be placed in or pass through one or more of the platform holes 102 to secure the items to the platform and/or better conceal the items as part of the display.

Figure 2:
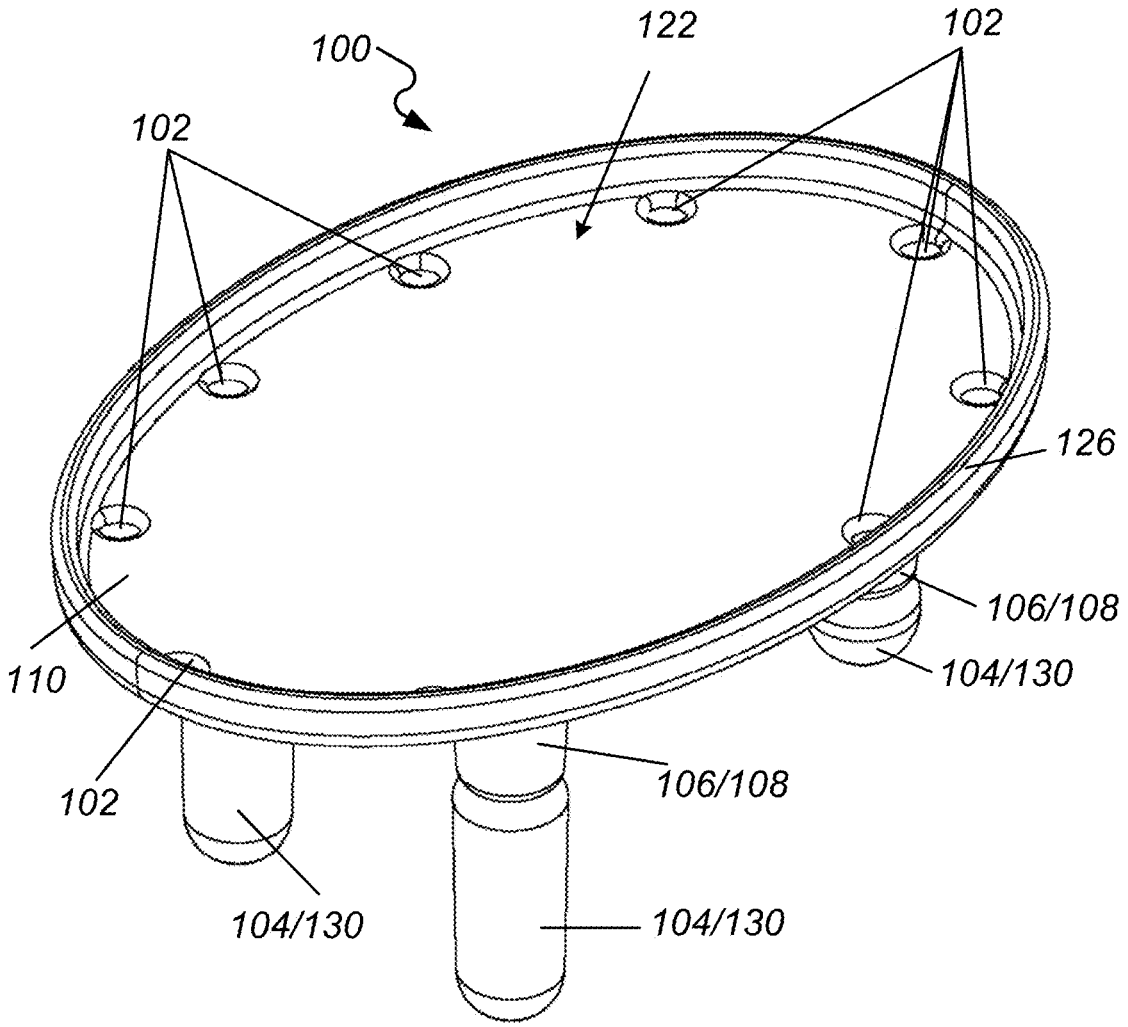

Better illustrated in at least FIG. 2, a raised contoured retaining ridge 126 can be positioned around the perimeter of the top surface 122 of platform 110 and configured to abate objects such as figurine 128 and other objects from sliding off the top surface 122 of platform 110 during use. In operation, the raised contoured retaining ridge 126 can be a separate part attached to platform 110 or integrally formed into platform 110. The raised contoured retaining ridge 126 abates objects from sliding off the platform for example, during lifting or moving of the non-flat oddly shaped display structure 202, inadvertent bumping by a person of the non-flat oddly shaped display structure 202, vibration of the non-flat oddly shaped display structure 202 over time, or in other cases.

In an exemplary embodiment, with regards to the height of the raised contoured retaining ridge 126, such height can be in the range of 0.25 inches to 1.0 inches and preferably in the range of 0.25 inches to 0.5 inches. The height of the raised contoured retaining ridge 126 is not particularly limited and can range as needed based on the requirements of a particular embodiment.

Figure 7:
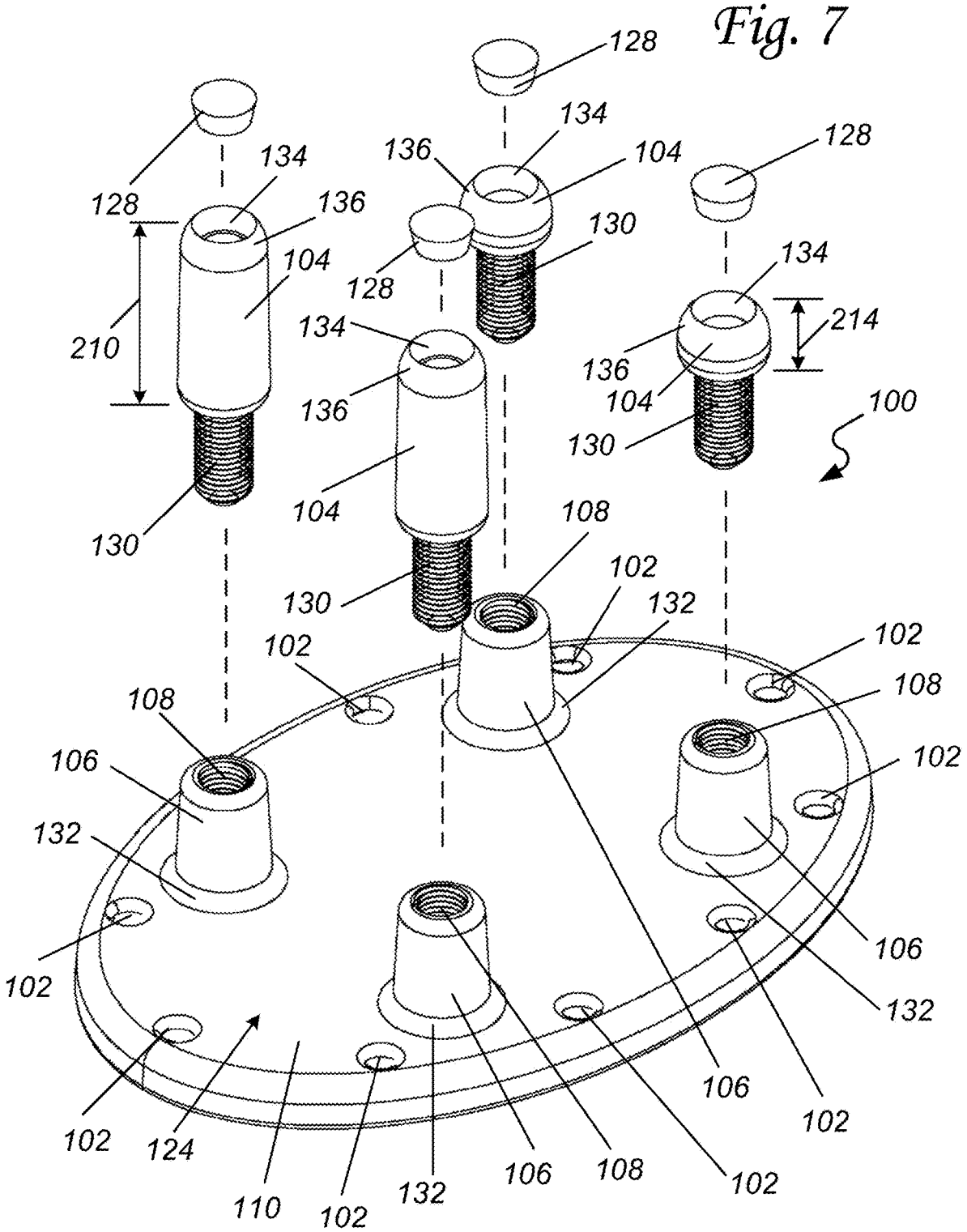

Better illustrated in at least FIG. 7, the figurine perch 100 can also comprise more than one standoff 106. Each of the standoffs 106 can be affixed to the bottom surface 124 of the platform 110. In operation, the standoffs 106 can be magnetically coupled to the platform 110, screwed or fastened to the platform 110, integrally formed into the platform 110, or attached in other suitable ways as may be required and/or desired in a particular embodiment.

Figure 6:
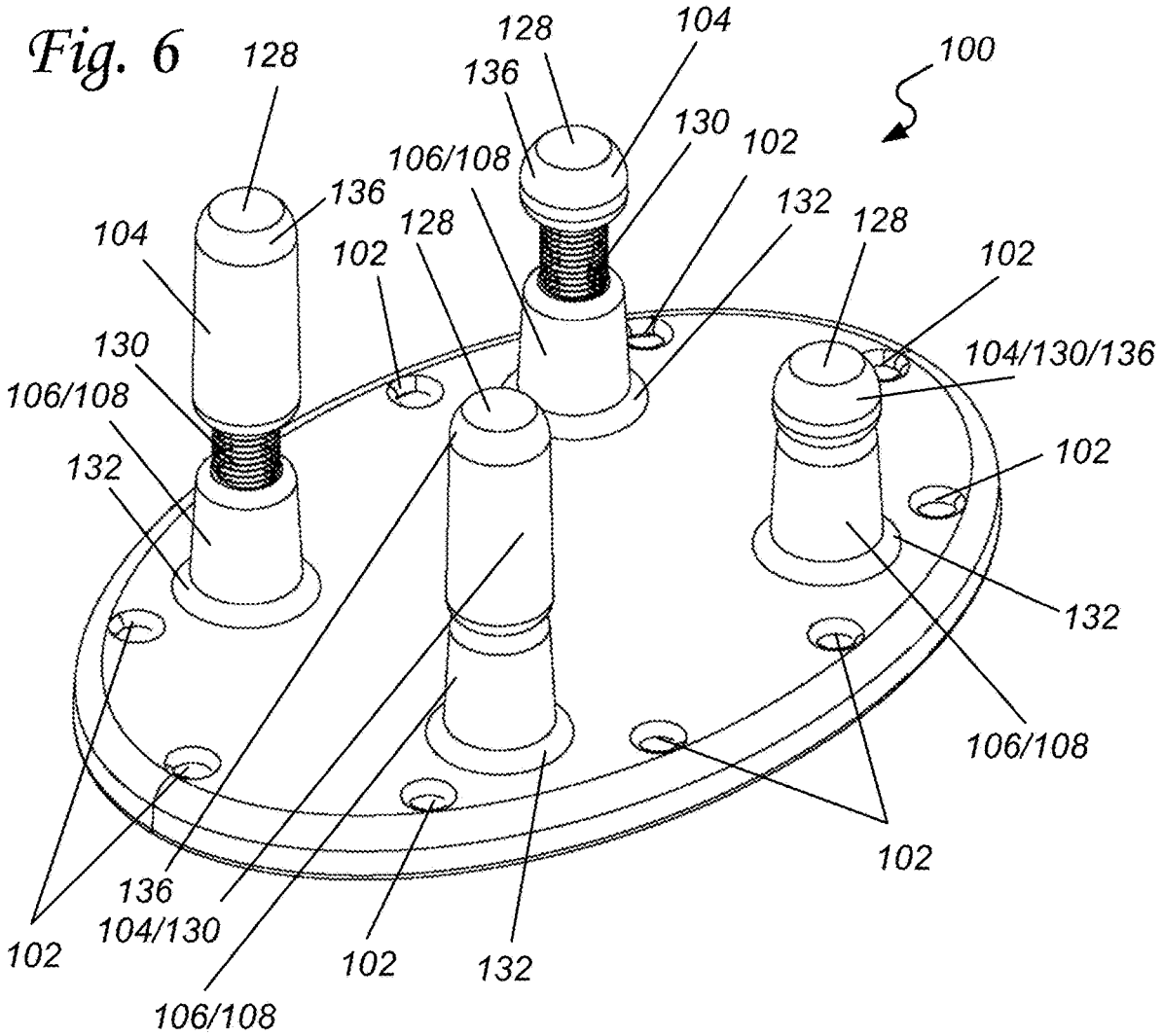
Figure 6:
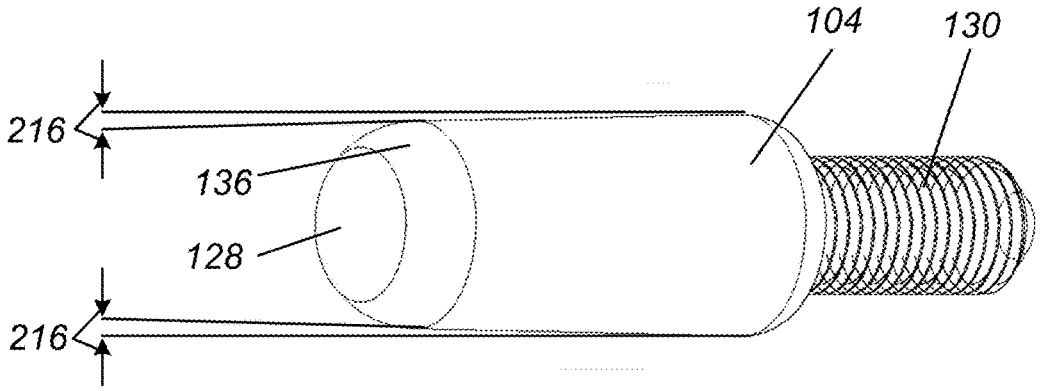

In an exemplary embodiment and better illustrated in at least FIG. 6, more than one stabilizing mount 104/130 can be used to secure and level the platform on top of the non-flat oddly shaped display structure 202. The stabilizing mount 104/130 can comprise a leg segment 104 and a rod segment 130 which is attached to one end of the leg segment 104. The other end of the leg segment 104 is a surface-contacting end 136 and placed in contact with the non-flat oddly shaped display structure 202 during use. The rod 130 can be fitted into the standoff 106 in an adjustable manner.

In an exemplary embodiment, stabilizing mount 104/130 can be fabricated from plastic, metal, wood, rubber, a combination thereof, or other suitable materials.

In operation, the length of each of the stabilizing mount 104/130 can be adjusted so that platform 110 is secure and level when placed on top of the non-flat oddly shaped display structure 202 so that at least one figurine 128 can be placed, for display, on platform 110 in a manner that prevents figurine 128 from falling off the non-flat oddly shaped display structure 202.

With reference to FIG. 1 reference 'B', there is illustrated a display referred to as a non-flat oddly shaped display structure 202. Such non-flat oddly shaped display structure 202 can be any suitable display in which a user would like to add a figurine perch 100 on top of it. Often such non-flat oddly shaped display structure 202 have a non-flat top surface making it impractical, even impossible to place a figurine 128 on top. An advantage, in the present, invention is that a flat platform 110 surfaces by way of the figurine perch 100 can be added to the top of the display and the figurine 128 can be safely and securely added to the top of the non-flat oddly shaped display structure 202. Figurine 128 can then be placed on platform 110 and displayed.

In an exemplary embodiment, at least one light source 118 can be interconnected with and pass through platform 110 by way of at least one of the platform holes 102. Such light sources 118 can be ultraviolet light (UV) light sources, light emitting diode (LED) light sources, or other suitable light sources as may be required and/or desired in a particular embodiment.

Figure 16:
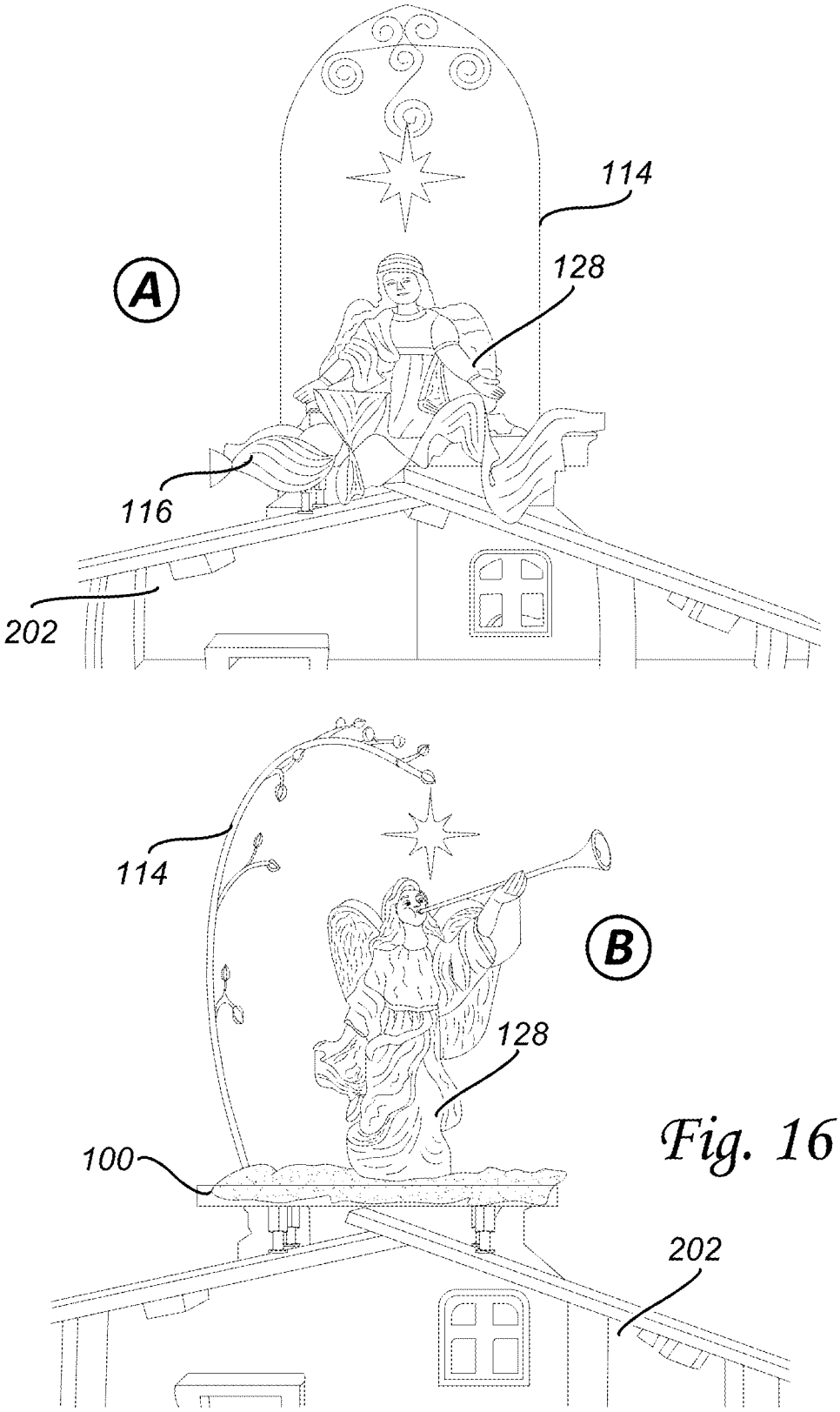

Better illustrated in at least FIG. 16 reference 'A', at least one mesh ribbon light source 116 can be positioned proximate to platform 110. Such mesh ribbon light source 116, projects light along the surface of the mesh ribbon light source 116 or reflects a backlit light source 118 that is positioned behind the mesh ribbon 116 light source.

Figure 3:
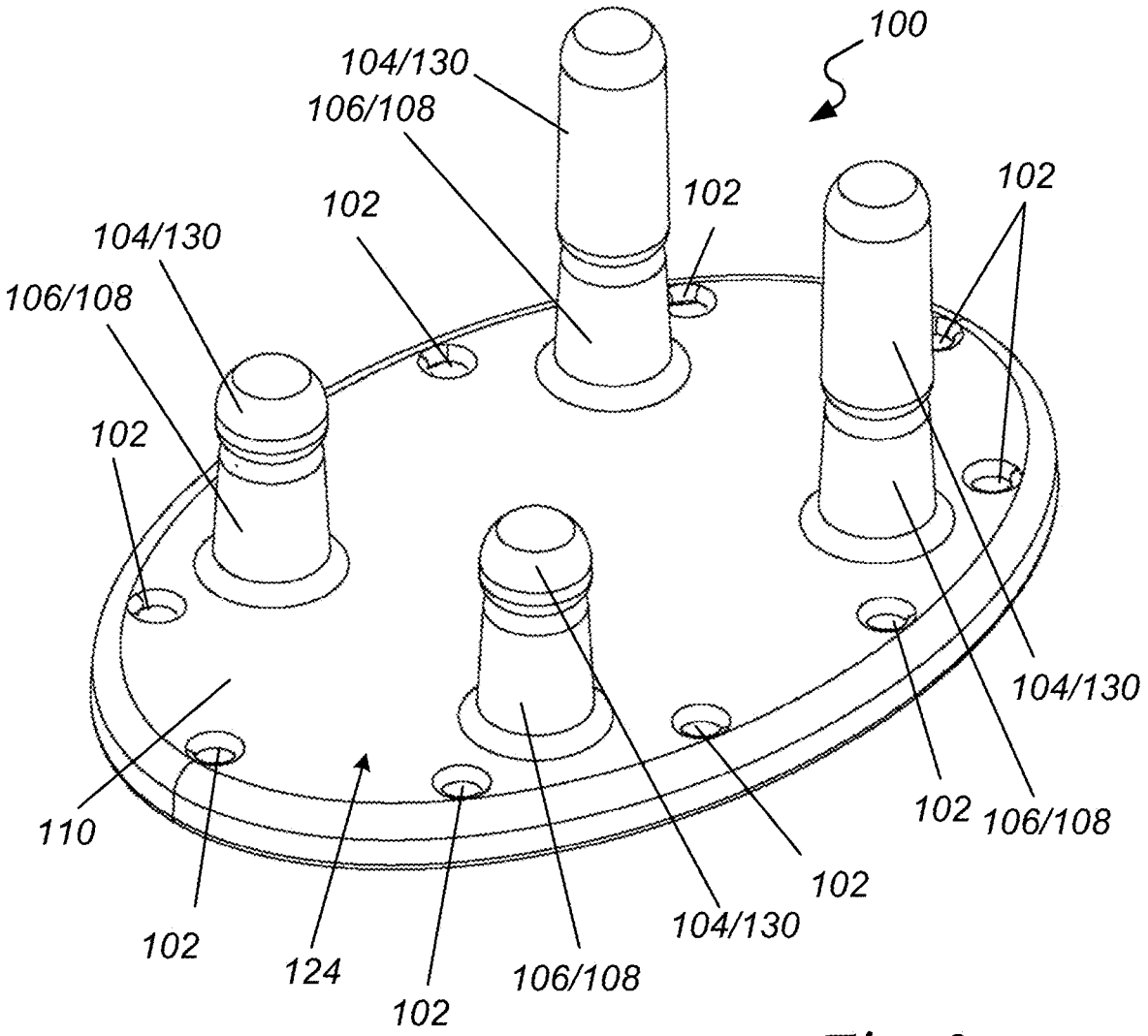
Figure 4:
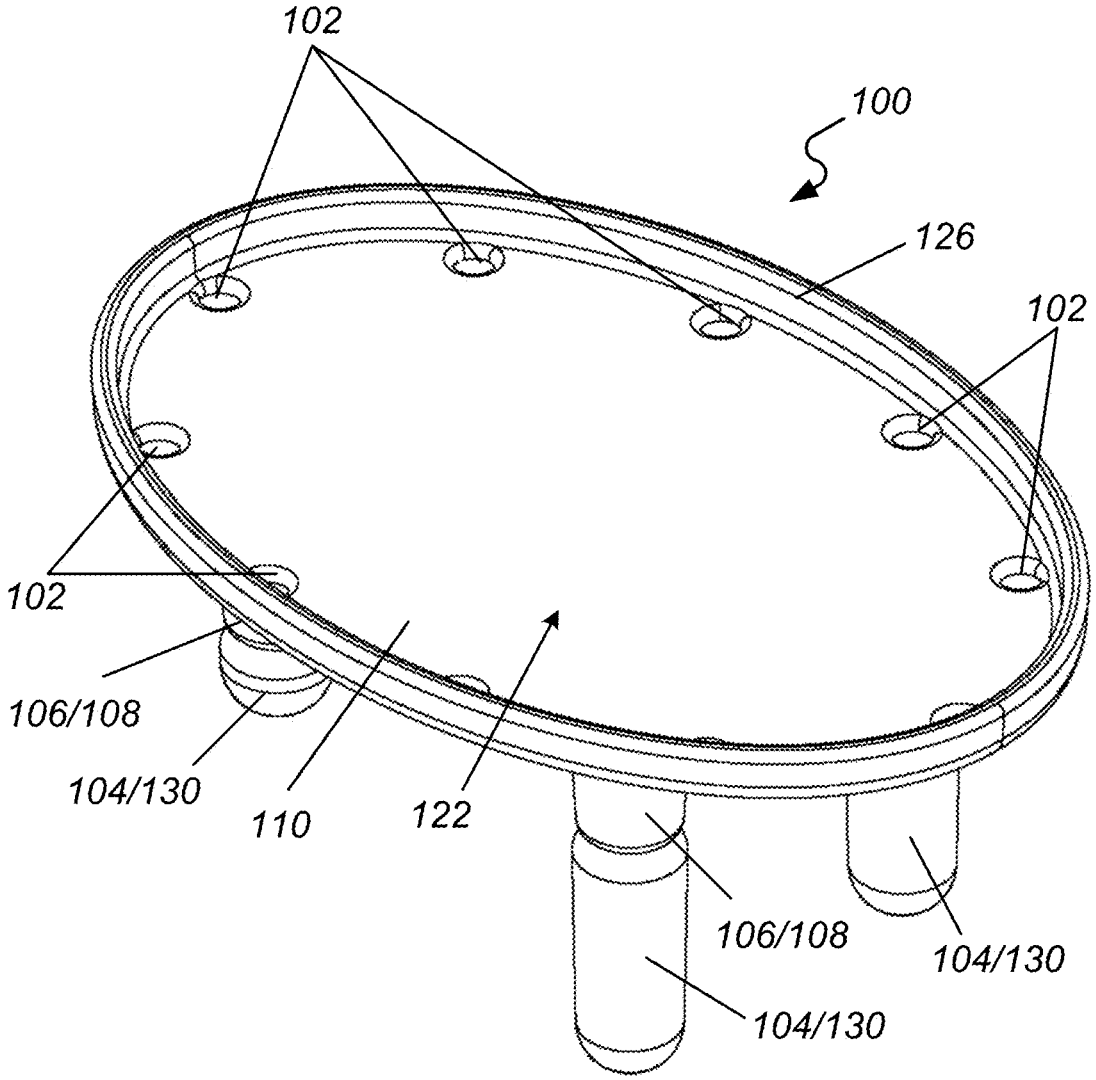
Figure 5:
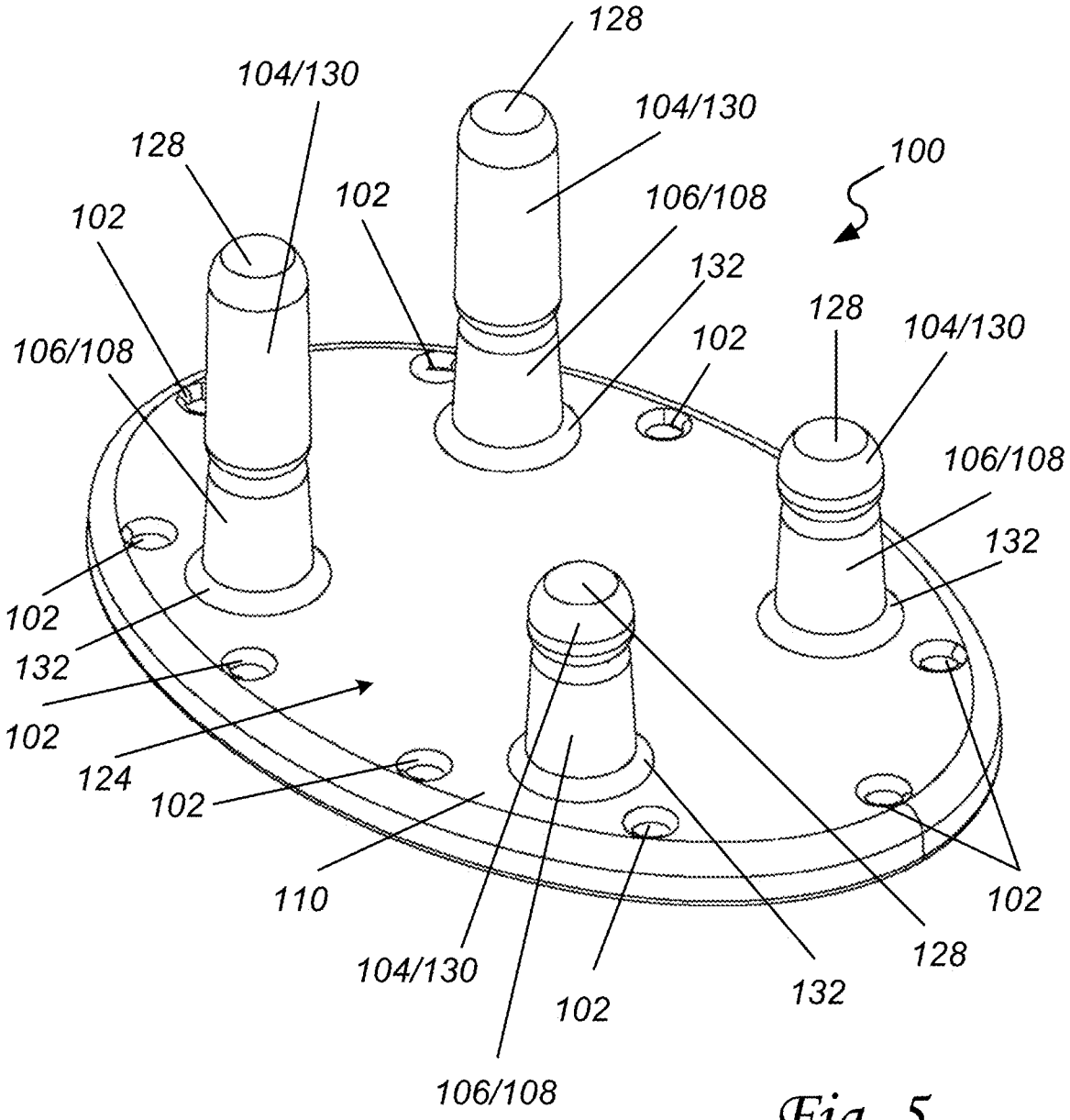

Referring to FIGS. 2 and 4, there are illustrated examples of a top surface 122 perspective view of the figurine perch 100. Referring to FIGS. 3, 5, and 6, there are illustrated examples of a bottom surface 124 perspective view of the figurine perch 100. In an exemplary embodiment, at least one leg segment 104 can be a different length 210 than the length 214 of the rest of the leg segment 104. In this regard, to provide flexibility in creating a secure and level platform 110 surface on a wide variety of the non-flat oddly shaped display structure 202 different length 210/214 leg segments 104 can interchangeably be used. In addition to movably changing the length of the entire stabilizing mount 104/130 by way of rod segment 130, different lengths 210/214 of the leg segment 104 can be interchangeably used, as may be required and/or desired in a particular embodiment.

In an exemplary embodiment, the leg segment 104 length can be in the range of 0.25 inches to 4 inches, and preferably in the range of 0.5 inches to 3 inches.

Referring to FIG. 6, there is illustrated one example of a bottom surface 124 perspective view of the figurine perch 100. In an exemplary embodiment, each of the stabilizing mounts 104/130 can be rotated or otherwise screwed in and out of the standoff 106 changing the length of the stabilizing mount 104/130 to better stabilize and create a flat and level platform 110 surface for a figurine 128 to be placed when the figurine perch 100 is placed on top of the non-flat oddly shaped display structure 202. Additionally, each leg segment 104 can be tapered 216 and the surface-contact end 136 rounded along with the gripping plug 128 to form an easy to grip and elegantly contoured leg segment 104. In this regard, the surface-contacting end 136 can be a smaller diameter than the end of the leg segment 104 attached to the rod segment 130.

Referring to FIG. 7, there is illustrated one example of a bottom surface 124 perspective view of the figurine perch 100 being assembled/disassembled.

In an exemplary embodiment, platform 110 has a top surface 122 and a bottom surface 124. The surface of platform 110 can have more than one platform hole positioned around and proximate to the perimeter of the platform. A raised contoured retaining ridge 126 can be positioned around the perimeter of the top surface 122 and configured to abate objects from sliding off the top surface 122 of the platform during use. More than one standoff 106 can have a threaded interior surface 108. Each of the standoffs 106 can be affixed to the bottom surface 124. More than one stabilizing mount 104/130 can comprise a leg segment 104 and a rod segment 130 that is threaded. At least one leg segment 104 can be a different length than the other of the leg segment 104. The rod segment 130 can be attached to one end of the leg segment 104 the other end of the leg segment 104 can be a surface-contacting end 136. The rod segment 130 can screw into the threaded interior surface 108 of the standoff 106 in an adjustable manner.

In an exemplary embodiment, the surface-contacting end 136 of the leg segment 104 can have a recess 134. A gripping plug 128 can be fitted into the recess 134. In this regard, the leg segment 104 is abated from slipping, by way of the gripping plug 128, when in contact with the non-flat oddly shaped display structure 202.

The gripping plug 128 can be a gripping type or kind of rubber, coated with an adhesive, have a hook and loop type surface, or be configured in other ways to provide a gripping type surface when in contact with the non-flat oddly shaped display structure 202, as may be required and/or desired in a particular embodiment.

In an exemplary embodiment, the threaded interior surface 108 can be a threaded insert 108 that is fitted into each of the standoffs 106. The rod segment 130 can be threaded such that the rod segment can screw into the threaded insert 108 in an adjustable manner.

In an exemplary embodiment, in operation, and with reference to FIG. 18, A method of using the figurine perch can comprise in step 1002 positioning the non-flat oddly shaped display structure 202 in a desired location. In step 1004, by placing the figurine perch 100 on top of the non-flat oddly shaped display structure 202. In step 1006, by adjusting the length of each of the stabilizing mounts 104/130 until platform 110 is secure and level. And, in step 1008, by placing at least one figurine 128 on top of the figurine perch 100/platform 110 for display.

Figure 10:
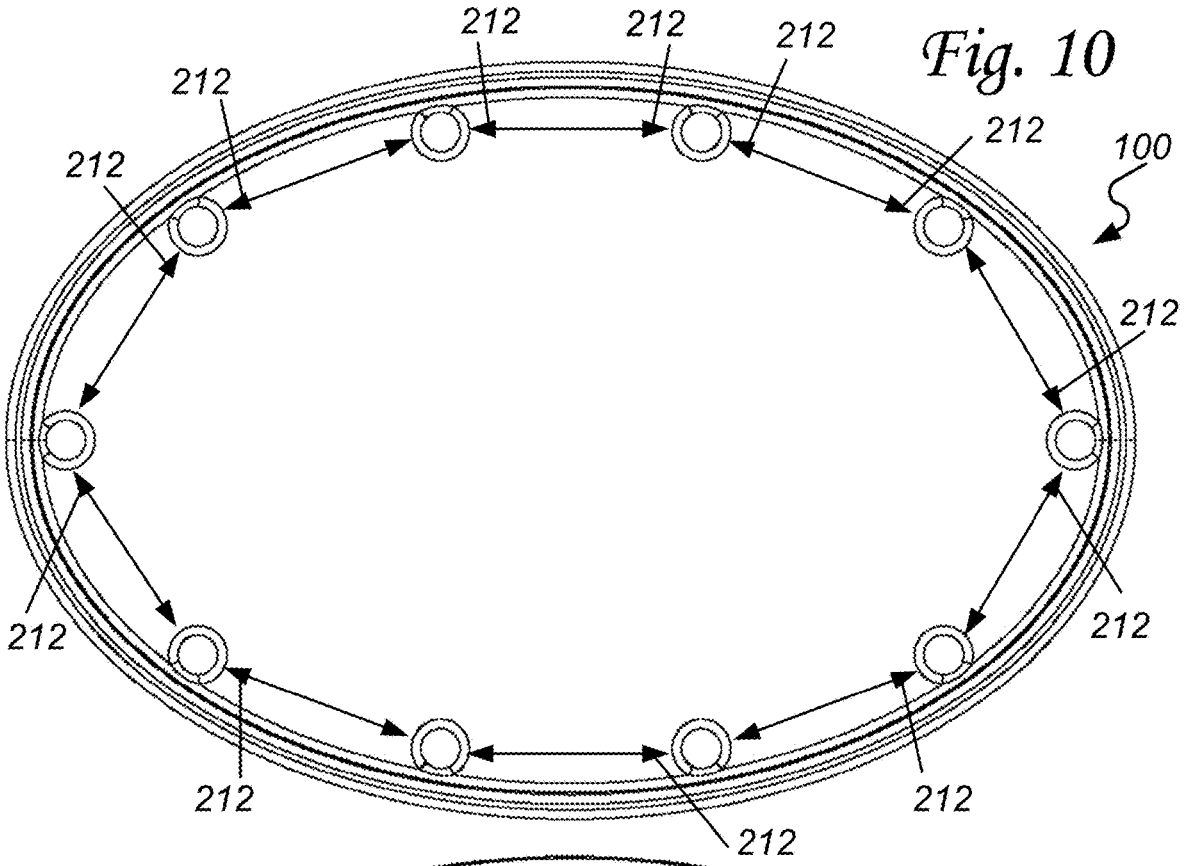
Figure 11:
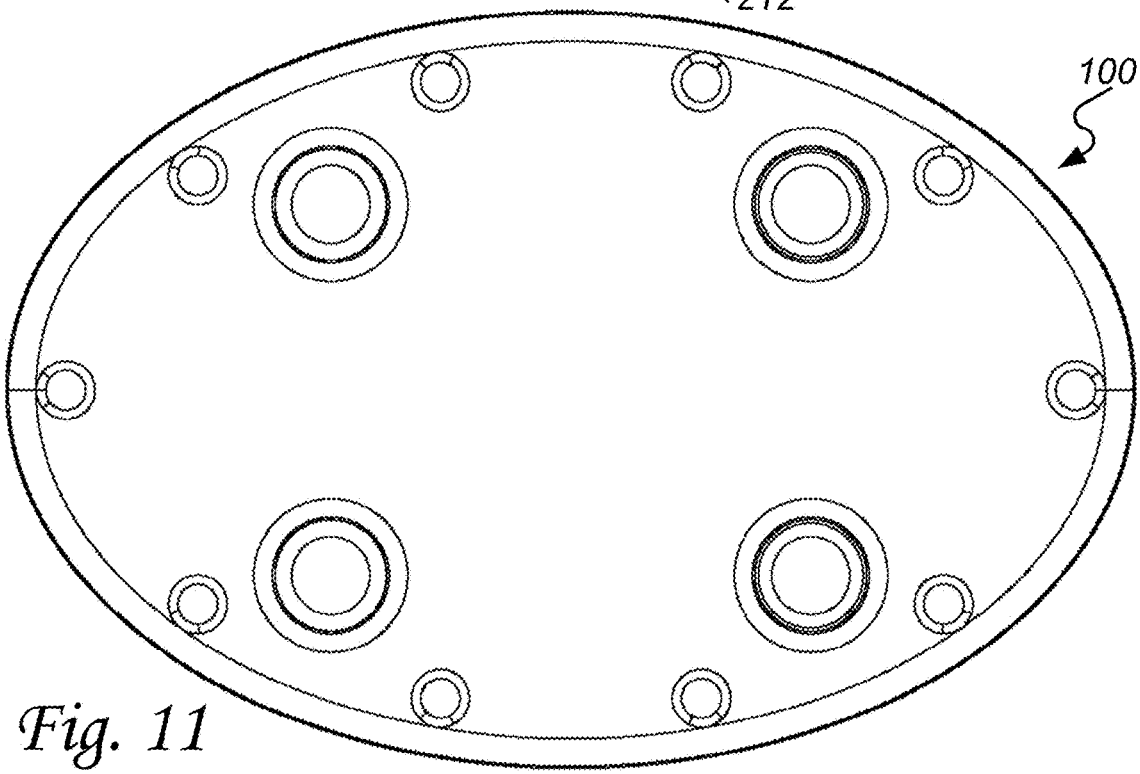

Referring to FIG. 8, there is illustrated one example of a right-side view of the figurine perch 100. Referring to FIG. 9, there is illustrated one example of a left-side view of the figurine perch 100. Referring to FIG. 10, there is illustrated one example of a top view of the figurine perch 100. Referring to FIG. 11, there is illustrated one example of a bottom view of the figurine perch 100. Referring to FIG. 12, there is illustrated one example of a back view of the figurine perch 100. Referring to FIG. 13, there is illustrated one example of a front view of the figurine perch 100.

In an exemplary embodiment and with reference to at least FIG. 10, the figurine perch 100 can comprise a platform 110 that has a top surface 122 and a bottom surface 124. The surface of the platform can have more than one platform hole positioned at a predetermined spacing interval 212.

In an exemplary embodiment, the predetermined spacing interval 212 can be in the range of 0.25 inches to 3 inches, and preferably in the range of 0.5 inches to 1.5 inches.

The figurine perch 100 can further comprise a raised contoured retaining ridge 126 that is positioned and integrally formed around the perimeter of the top surface 122. The raised contoured retaining ridge 122 is configured to abate objects from sliding off the top surface 122 of platform 110 during use. More than one standoff 106 can have a threaded interior surface 108. Each standoff 106 can be integrally formed on the bottom surface 124 of platform 110. More than one stabilizing mount 104/130. The stabilizing mount 104/130 can comprise a leg segment 104 and a rod segment 130 that is threaded. At least one of the leg segments 104 can be a different length 210 than the length 214 of the other leg segments 104. The rod segment 130 attaches to one end of leg segment 104 and the other end of leg segment 104 is a surface-contacting end 136. The rod segment 130 screws into the threaded interior surface 108 of the standoff 106 in an adjustable manner.

The figurine perch 100 can further comprise a gripping plug, and the surface-contacting end 136 of the leg segment 104 can have a recess 134. The gripping plug 128 can be fitted into recess 134. In operation, by way of the gripping plug, the leg segment 104 is abated from slipping, by way of the gripping plug 128, when in contact with the non-flat oddly shaped display structure 202.

Figure 14:
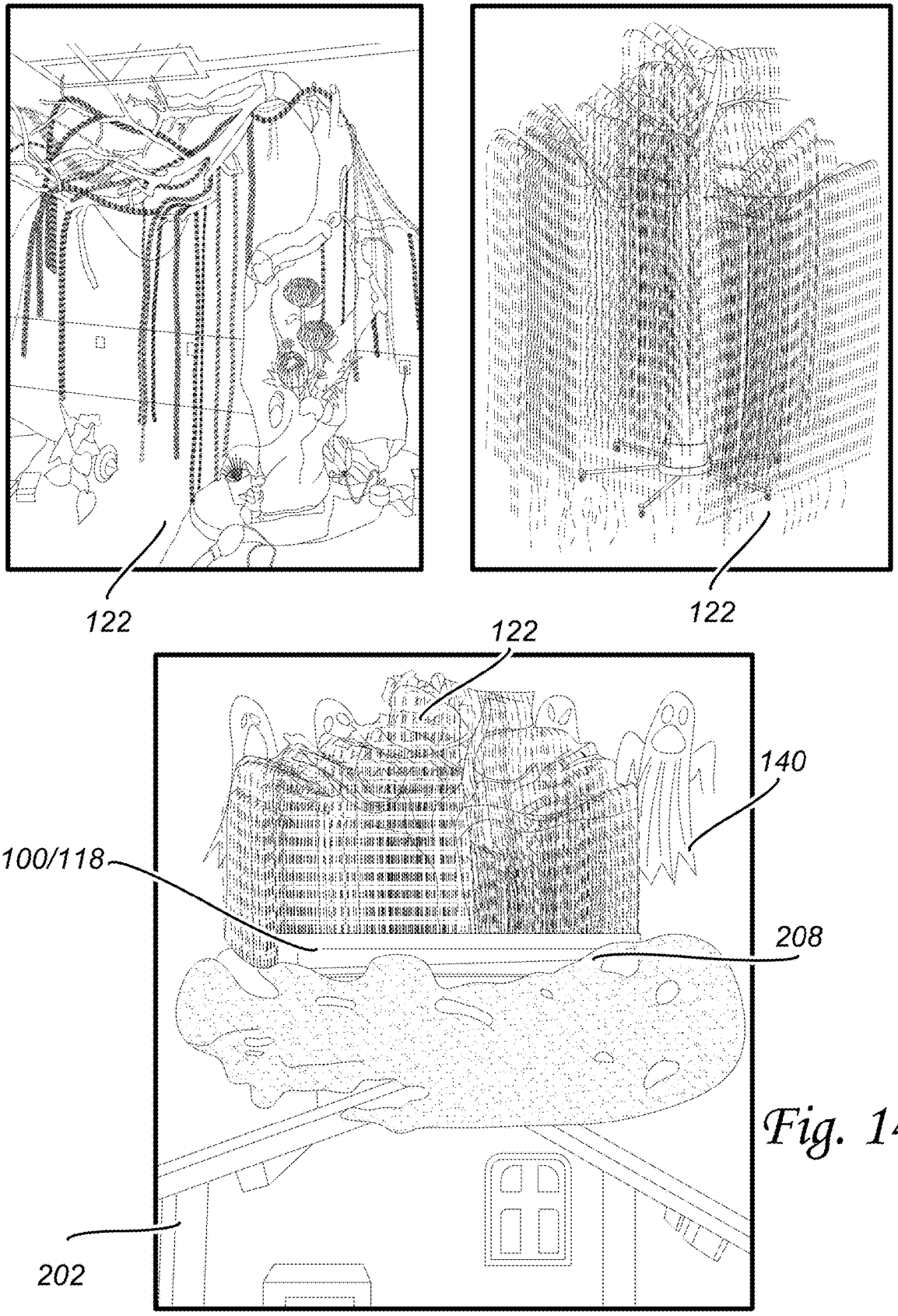
FIG. 14 illustrates examples of lighting for a figurine perch.

Referring to FIG. 14, there are illustrated examples of lighting for a figurine perch 100. In an exemplary embodiment, including examples of lighted figurine 122 that can be positioned on platform 110. Such lighted figurines 122 can use fiber optic strands and other techniques to light the figurine to create the desired display effect. Additionally, at least one backdrop 140 can be positioned proximate to platform 110. Furthermore, clouds or smoke illusion 208 can be created with cotton or other suitable materials, as may be required and/or desired in a particular embodiment.

In an exemplary embodiment, an image projecting light source 118 can be positioned to broadcast lighted images on surfaces such as backdrop 140, platform 110, display structure 202, or other surfaces, as may be required and/or desired in a particular embodiment.

Figure 15:
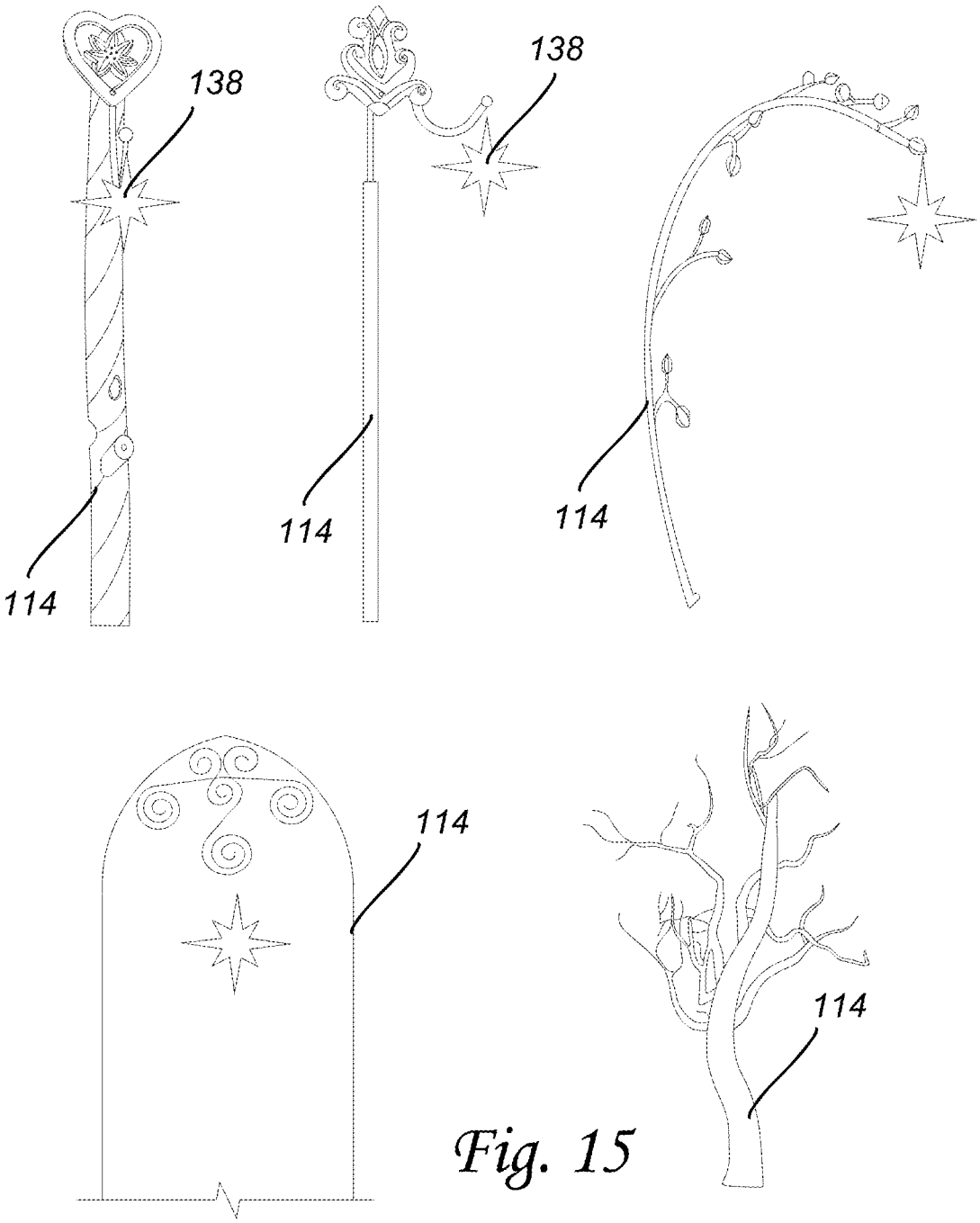
FIGS. 15-16 illustrate examples of hangers for use with a figurine perch.

Referring to FIGS. 15 and 16, there are illustrated examples of hangers for use with the figurine perch 100. In an exemplary embodiment, at least one hanger 114 can be interconnected with at least one of the platform holes 102. Additionally, the hanger 114 can further comprise at least one hook 138.

Figure 17:
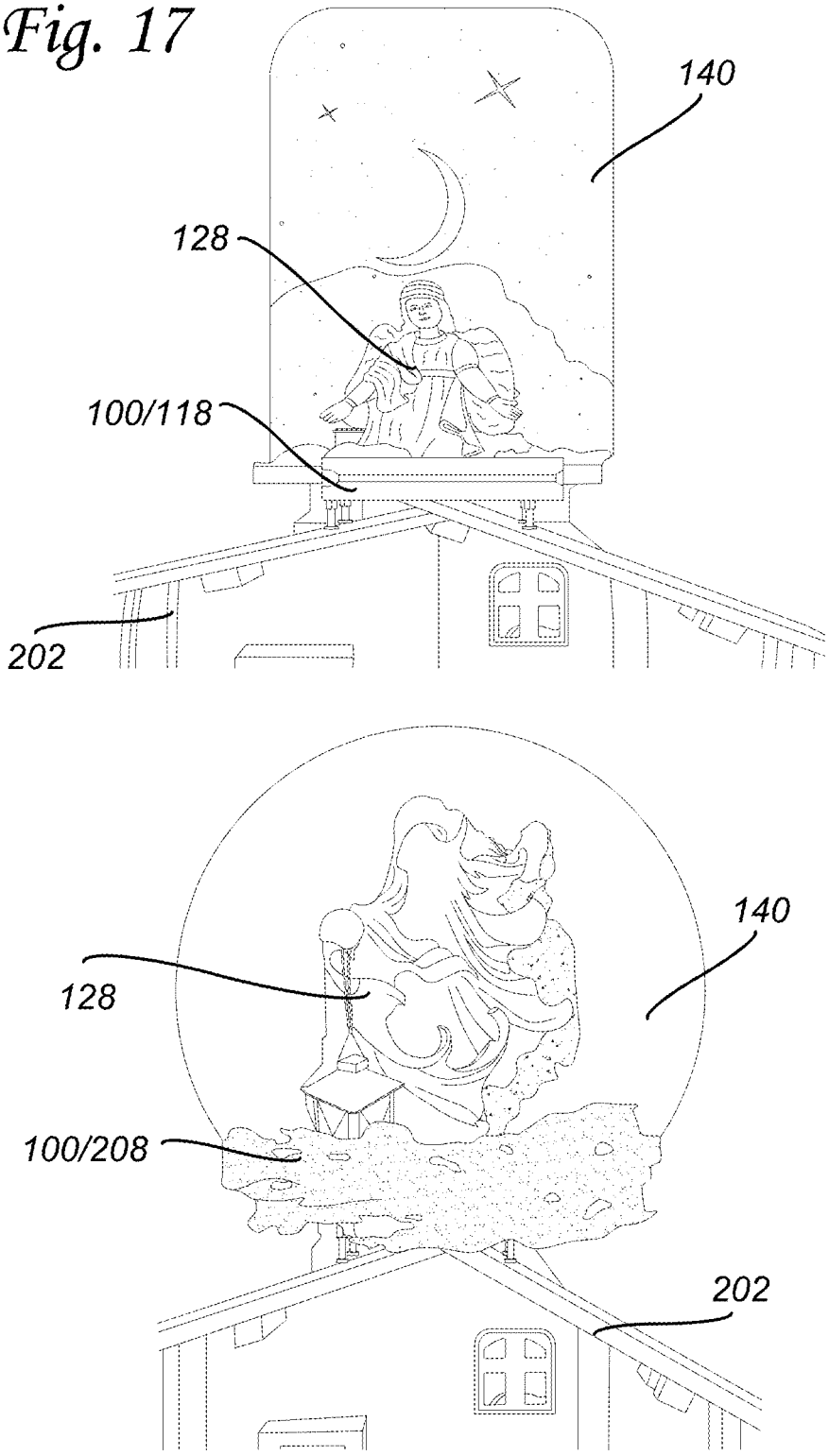
FIG. 17 illustrates examples of a backdrop for use with a figurine perch.

Referring to FIG. 17, there are illustrated examples of a backdrop 140 for use with a figurine perch. In an exemplary embodiment, At least one backdrop 140 can be positioned proximate to the platform. In operation, backdrop 140 can be positioned proximate to platform 110 preferably behind figurine 128 or lighted figurine 122.

Such backdrops 140 can be printed card stock, three-dimensional type objects, or other suitable types or kinds of backdrops 140, as may be required and/or desired in a particular embodiment.

While the preferred embodiment of the invention has been described, it will be understood that those skilled in the art, both now and in the future, may make various improvements and enhancements which fall within the scope of the claims which follow. These claims should be construed to maintain the proper protection for the invention first described.

What is claimed is:

1. A figurine perch that when placed on top of a non-flat oddly shaped display structure provides a secure and level surface so that at least one figurine can be placed for display, the figurine perch comprising:

a platform having a top surface and a bottom surface, surface of the platform having more than one of a platform hole positioned around and proximate to the perimeter of the platform;

a raised contoured retaining ridge is positioned around the perimeter of the top surface and configured to abate objects from sliding off the top surface of the platform during use;

more than one of a standoff, each of the standoff is affixed to the bottom surface; and more than one of a stabilizing mount, the stabilizing mount comprises a leg segment and a rod segment which is attached to one end of the leg segment and the other end of the leg segment is a surface-contacting end, the rod is fitted into the standoff in an adjustable manner;

wherein the length of each of the stabilizing mount is adjusted so that the platform is secure and level when placed on top of the non-flat oddly shaped display structure so that at least one figurine can be placed, for display, on the platform in a manner that prevents the figurine from falling off the non-flat oddly shaped display structure.

2. The figurine perch in accordance with claim 1, at least one of the leg segment is a different length than the other of the leg segment.

3. The figurine perch in accordance with claim 1, further comprising:

a gripping plug, the surface-contacting end of the leg segment having a recess, the gripping plug is fitted into the recess, wherein the leg segment is abated from slipping, by way of the gripping plug, when in contact with the non-flat oddly shaped display structure.

4. The figurine perch in accordance with claim 1, further comprising:

a threaded insert is fitted into each of the standoff, the rod segment is threaded, the rod segment screws into the threaded insert in an adjustable manner.

5. The figurine perch in accordance with claim 1, further comprising:

at least one of a light source is interconnected with and passes through the platform by way of at least one of the platform hole.

6. The figurine perch in accordance with claim 5, the light source is one of the following: an ultraviolet light source, or a light emitting diode (LED) light source.

7. The figurine perch in accordance with claim 1, further comprising:

at least one of a mesh ribbon light source that is positioned proximate to the platform.

8. The figurine perch in accordance with claim 1, further comprising:

at least one of a hanger interconnects with at least one of the platform hole.

9. The figurine perch in accordance with claim 8, the hanger further comprises at least one of a hook.

10. The figurine perch in accordance with claim 1, further comprising:

at least one of a backdrop is positioned proximate to the platform.

11. The figurine perch in accordance with claim 1, further comprising:

at least one of an image projecting light source is positioned to broadcast a lighted image on the surfaces proximate to the figurine perch.

12. The figurine perch in accordance with claim 1, the platform shape is one of the following circular, oval, square, or rectangle.

13. A method of using the figurine perch of claim 1, comprising the steps of:

positioning the non-flat oddly shaped display structure in a desired location;

placing the figurine perch on top of the non-flat oddly shaped display structure;

adjusting the length of each of the stabilizing mount until the platform is secure and level; and placing at least one figurine on top of the figurine perch for display.

14. A figurine perch that when placed on top of a non-flat oddly shaped display structure provides a secure and level surface so that at least one figurine can be placed for display, the figurine perch comprising:

a platform having a top surface and a bottom surface, surface of the platform having more than one of a platform hole positioned around and proximate to the perimeter of the platform;

a raised contoured retaining ridge is positioned around the perimeter of the top surface and configured to abate objects from sliding off the top surface of the platform during use;

more than one of a standoff having a threaded interior surface, each of the standoff is affixed to the bottom surface; and more than one of a stabilizing mount, the stabilizing mount comprises a leg segment and a rod segment that is threaded, at least one of the leg segment is a different length than the other of the leg segment, the rod segment attaches to one end of the leg segment the other end of the leg segment is a surface-contacting end, the rod segment screws into the threaded interior surface of the standoff in an adjustable manner;

wherein the length of each of the stabilizing mount is adjusted so that the platform is secure and level when placed on top of the non-flat oddly shaped display structure so that at least one figurine can be placed, for display, on the platform in a manner that prevents the figurine from falling off the non-flat oddly shaped display structure.

15. The figurine perch in accordance with claim 14, further comprising:

at least one of a light source is interconnected with and passes through the platform by way of at least one of the platform hole.

16. The figurine perch in accordance with claim 14, further comprising:

at least one of a hanger interconnects with at least one of the platform hole.

17. A figurine perch that when placed on top of a non-flat oddly shaped display structure provides a secure and level surface so that at least one figurine can be placed for display, the figurine perch comprising:

a platform having a top surface and a bottom surface, surface of the platform having more than one of a platform hole positioned at a predetermined spacing interval;

a raised contoured retaining ridge is positioned and integrally formed around the perimeter of the top surface, the raised contoured retaining ridge is configured to abate objects from sliding off the top surface of the platform during use;

more than one of a standoff having a threaded interior surface, each of the standoff is integrally formed on the bottom surface;

more than one of a stabilizing mount, the stabilizing mount comprises a leg segment and a rod segment that is threaded, at least one of the leg segment is a different length than the other of the leg segment, the rod segment attaches to one end of the leg segment the other end of the leg segment is a surface-contacting end, the rod segment screws into the threaded interior surface of the standoff in an adjustable manner; and a gripping plug, the surface-contacting end of the leg segment having a recess, the gripping plug is fitted into the recess, wherein the leg segment is abated from slipping, by way of the gripping plug, when in contact with the non-flat oddly shaped display structure;

wherein the length of each of the stabilizing mount is adjusted so that the platform is secure and level when placed on top of the non-flat oddly shaped display structure so that at least one figurine can be placed, for display, on the platform in a manner that prevents the figurine from falling off the non-flat oddly shaped display structure.

18. The figurine perch in accordance with claim 17, further comprising:

at least one of a light source is interconnected with and passes through the platform by way of at least one of the platform hole.

19. The figurine perch in accordance with claim 17, the platform shape is one of the following oval.

20. The figurine perch in accordance with claim 17, further comprising:

at least one of a hanger interconnects with at least one of the platform hole.

* * * * *